US010278559B1

(12) United States Patent
Boender et al.

(10) Patent No.: US 10,278,559 B1
(45) Date of Patent: May 7, 2019

(54) FOAMING FLOOR CLEANER APPARATUS AND SYSTEM

(71) Applicant: Foaming Floors LLC, Powell, OH (US)

(72) Inventors: Eric J. Boender, Grand Rapids, MI (US); Robert R. DeWeese, Powell, OH (US)

(73) Assignee: Foaming Floors LLC, Powell, OH (US)

( * ) Notice: Subject to any disclaimer, the term of this patent is extended or adjusted under 35 U.S.C. 154(b) by 165 days.

(21) Appl. No.: 14/876,339

(22) Filed: Oct. 6, 2015

Related U.S. Application Data

(60) Provisional application No. 62/060,243, filed on Oct. 6, 2014.

(51) Int. Cl.
*A47L 11/34* (2006.01)
*A47L 11/40* (2006.01)

(52) U.S. Cl.
CPC ..... *A47L 11/34* (2013.01); *A47L 11/4041* (2013.01); *A47L 11/4072* (2013.01); *A47L 11/4075* (2013.01); *A47L 11/4083* (2013.01)

(58) Field of Classification Search
CPC .. A47L 11/34; A47L 11/4041; A47L 11/4072; A47L 11/4075; A47L 11/4083; A47L 11/4044; A47L 11/4088; A47L 11/30
See application file for complete search history.

(56) References Cited

U.S. PATENT DOCUMENTS 3,178,756 A * 4/1965 Ballantyne ..... A47L 11/325 401/47
3,428,985 A * 2/1969 Boyd ..... A47L 11/325 15/50.3
3,624,861 A * 12/1971 Freiheit ..... A47L 11/302 15/320
3,751,755 A * 8/1973 Smith ..... A47L 11/30 137/205

(Continued)

OTHER PUBLICATIONS

XL North Commercial Grade Wet n' Dry XLerator Floor Care Machine Brochure, XL North, Fall River, MA 02722 USA, 2011.

(Continued)

*Primary Examiner* — Robert J Scruggs
(74) *Attorney, Agent, or Firm* — Gardner, Linn, Burkhart & Ondersma LLP

(57) ABSTRACT

A floor cleaning device comprising a base portion defining an internal cavity, with a handle connected with the base portion and configured to enable an operator to manipulate the base portion over a floor surface. A brush or brushes, such as counter rotating cylindrical brushes, are disposed for rotation within the internal cavity. A supply line is configured to deliver foam to the base portion with a manifold disposed in the base portion being operatively connected with the supply line and including a plurality of apertures whereby foam delivered through the supply line is discharged out of the apertures. The floor cleaning device is useable with a tank apparatus as a floor cleaner system, where the tank apparatus includes a reservoir for cleaning solution and an air compressor for delivering cleaning solution and compressed air via hoses to the floor cleaning device.

21 Claims, 18 Drawing Sheets

(56) References Cited

U.S. PATENT DOCUMENTS

| | | | | | |
|---|---|---|---|---|---|
| 4,139,922 | A * | 2/1979 | Fitch | A47L 11/302 | 15/321 |
| 4,329,756 | A * | 5/1982 | Chicoine | A47L 11/34 | 15/321 |
| 4,360,946 | A * | 11/1982 | Marshall, Jr. | A47L 11/34 | 15/321 |
| 4,542,556 | A * | 9/1985 | Hepple | A47L 11/34 | 15/321 |
| 4,974,618 | A * | 12/1990 | Nysted | A47L 11/34 | 134/21 |
| 5,127,128 | A * | 7/1992 | Lee | A47L 11/30 | 15/322 |
| 8,887,340 | B2 * | 11/2014 | Pedlar | A47L 11/24 | 15/320 |

OTHER PUBLICATIONS

FOAM-iT Portable Foam Unit 30 gallon brochure, Innovative Cleaning Equipment Inc., (www.foamit.com), publication date unknown.

User Manual, 30 Gallon Air Operated Portable Foam Equipment, Innovative Cleaning Equipment Inc., believed to have been published in 2014.

FOAM-iT Portable Foam Unit for concentrate products brochure, Innovative Cleaning Equipment Inc., (www.foamit.com), publication date unknown.

User Manual, 15 Gallon Air Operated Portable Foam Unit for Concentrate Products, Innovative Cleaning Equipment, Inc., believed to have been published in 2014.

Diversey Dry Foam Carpet Care System webpage, TASKI, (www.taski.com), disclosing device believed to be publicly available prior to Oct. 6, 2014.

Air Cell Extraction with Encapsulation brochure, Von Schrader LmX, Low Moisture Soil Extraction Carpet Cleaning System, disclosing device believed to be publicly available prior to Oct. 6, 2014.

Inventor Statement regarding third-party use of a cleaning device prior to Oct. 6, 2014.

Whittaker Smart Care TWIN Machine Operator's Manual, disclosing machine that was available more than one year prior to Oct. 6, 2014.

* cited by examiner

FOAMING FLOOR CLEANER APPARATUS AND SYSTEM

CROSS REFERENCE TO RELATED APPLICATION

The present application claims priority of U.S. provisional application Ser. No. 62/060,243 filed Oct. 6, 2014, for FOAMING FLOOR CLEANER APPARATUS AND SYSTEM, which is hereby incorporated herein by reference in its entirety

BACKGROUND OF THE INVENTION

The present invention is directed to a floor cleaner device, and in particular to an apparatus and system suited for cleaning carpet with foam.

Various floor cleaners are known, including counter-rotating brush machines for use with carpet. These include a base within which a pair of cylindrical counter-rotating brushes are located, with a handle connected to the base whereby an operator can manipulate the floor cleaner over a surface.

SUMMARY OF THE INVENTION

The present invention provides a floor cleaning device and system for cleaning surfaces, such as carpeted surfaces with foam.

According to an aspect of the present invention, a floor cleaning device includes a base portion defining an internal cavity, one or more brushes are configured for rotation within the internal cavity, and a supply line configured to deliver foam to the base portion. At least one aperture is disposed within the internal cavity, with the aperture being operatively connected with the supply line whereby foam delivered through the supply line is discharged out of the aperture and within the internal cavity.

In a particular embodiment the brushes are cylindrical, counter rotating brushes. The base portion of the cleaning device may further include a plate or brush cover member within which the apertures are formed. Still further, a horizontally extending manifold may be disposed above the plate member.

According to another aspect of the present invention a floor cleaning system includes a floor cleaning device, such as described above and includes an air compressor and a tank apparatus for generating foam. The tank apparatus includes a reservoir for retaining a liquid cleaning solution and is configured to being moved by an operator within an interior space having a floor that is to be cleaned. The system further includes an airline for delivering compressed air and a solution line for delivering cleaning solution from the reservoir. The airline and solution line are operatively connected with the supply line of the cleaning device to deliver foam to the base portion of the cleaning device.

In a particular embodiment the tank apparatus includes wheels and the air compressor is mounted to the tank apparatus. The airline and solution line then extend from the tank apparatus to the floor cleaning device.

The floor cleaning system enables an adequate supply of liquid cleaning solution to be transported via the tank apparatus and used at the job site, without the necessity of the cleaning solution being retained on the cleaning device itself. Due to the weight of water, only a limited supply would otherwise be able to be retained on the handheld, non-wheeled cleaning device due to the inability of an operator to support such weight and volume of cleaning solution. As a flooring surface is cleaned, the transportable tank apparatus may be moved to alternative locations while being in fluid communication with the cleaning device. Moreover, the ability to supply both liquid cleaning solution and compressed air enables the generation of foam to provide superior cleaning. These and other objects, advantages, purposes and features of this invention will become apparent upon review of the following specification in conjunction with the drawings.

DESCRIPTION OF THE PREFERRED EMBODIMENTS

Figure 1:
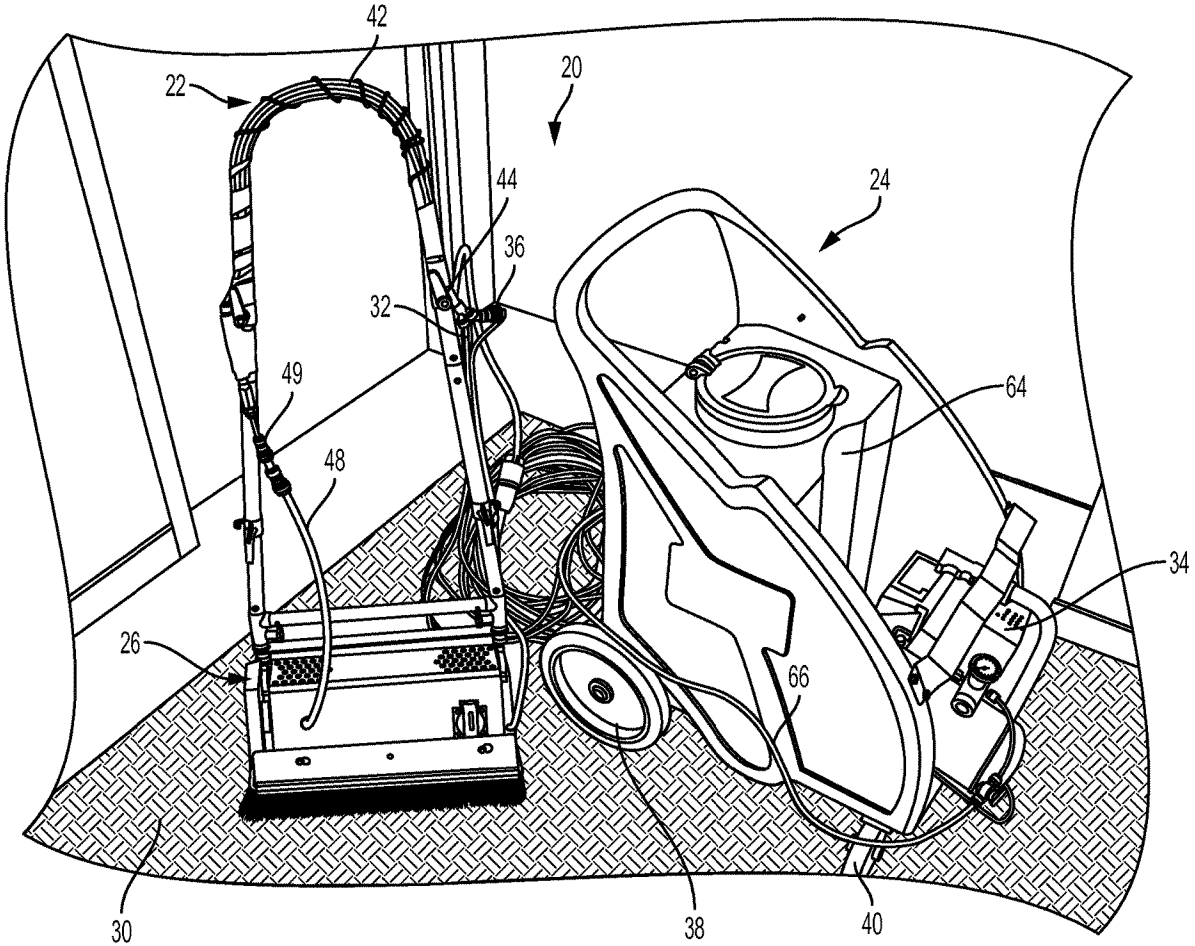
FIG. 1 is a perspective view of a floor cleaner system in accordance with the present that includes a floor cleaner device and a tank apparatus.
Figure 3:
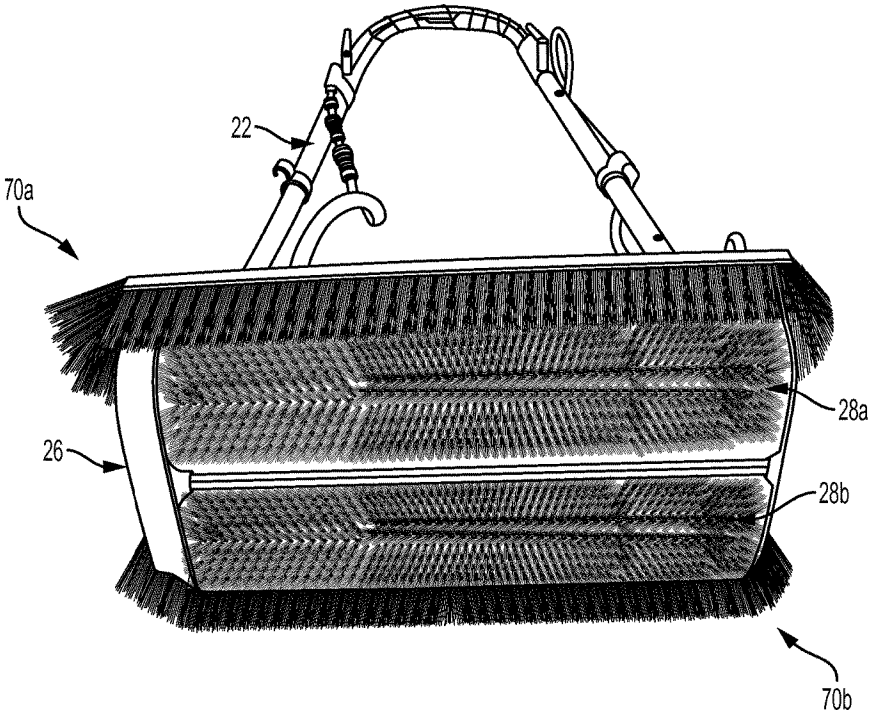
FIG. 3 is a bottom view of the floor cleaner device of FIG. 2 showing a pair of brushes mounted thereto.

The present invention will now be described with reference to the accompanying figures, wherein the numbered elements in the following written description correspond to like-numbered elements in the figures. FIG. 1 discloses an embodiment of a foaming floor cleaning system 20 in accordance with the present invention, where system 20 is shown to include a floor cleaning device or apparatus 22 and a tank apparatus 24. Floor cleaning device 22 includes a base or lower portion 26 to which are mounted a pair of brushes 28*a*, 28*b* (FIG. 3) that are driven for rotation to clean a floor surface, such as a carpeted floor 30. In use, as discussed in more detail below, a cleaning solution is discharged from base 26, which in the illustrated embodiment comprises a foam cleaning solution that is then agitated against the carpet 30 by brushes 28*a*, 28*b*. The liquid solution is delivered from tank apparatus 24 to cleaning device 22 via a hose 32, with tank apparatus 24 further including an air compressor 34 mounted thereto for the delivery of compressed air to cleaning device 22 via hose 36 that is used in the creation of the foam cleaning solution. Tank apparatus 24 includes wheels 38, 40 whereby tank apparatus 24 may be positioned at or near an area at which cleaning device 22 is to be used to clean a floor. The mobility of tank apparatus 24 thus enables a carpeted floor 30 to be readily and effectively cleaned by way of foam cleaning device 22.

Figure 2:
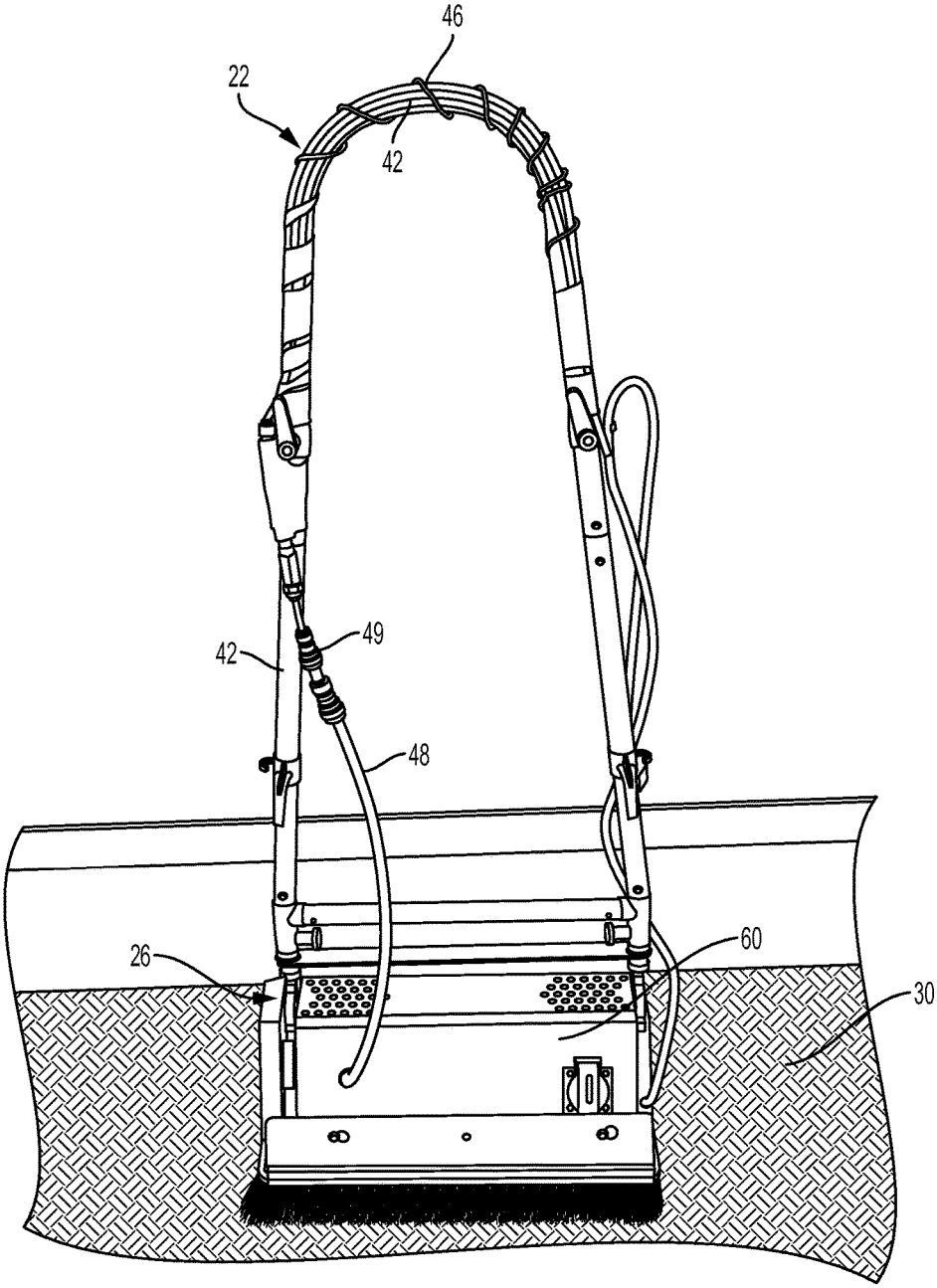
FIG. 2 is a perspective view of the floor cleaner device shown apart from the system of FIG. 1.
Figure 5:
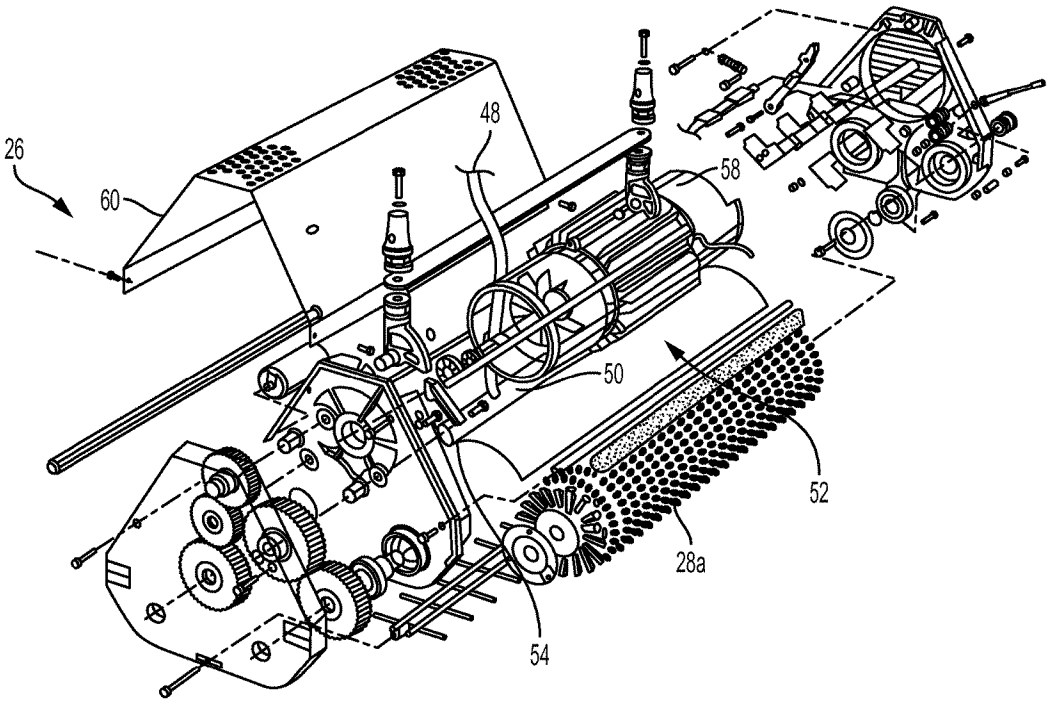
FIG. 5 is an exploded perspective view of a lower portion of the floor cleaner device of FIG. 2.

Referring now to FIGS. 1 and 2, cleaning device 22 generally includes a handle 42 that is connected with base 26 and is grasped by an operator for movement of device 22 over a floor surface. In the illustrated embodiment, hoses 32, 36 join to handle 42 at connector 44 (FIG. 6), with a delivery line 46 disposed about handle 42. Line 46 further includes a hose or tube 48 joined at connector 49, with tube 48 delivering the foam cleaning solution to base 26. It should be appreciated that alternative arrangements for the delivery of the foam cleaning solution to base 26 may be employed. As understood from FIG. 5, tube 48 extends internally of base 26 and is connected with an internal manifold or pipe or tube 50. Manifold 50, in turn, is attached to a brush cover plate 52 of cleaning device 22. In particular in the illustrated embodiment, manifold 50 is located at a valley 54 formed in cover plate 52, where cover plate 52 is formed to include a pair of channels 56*a*, 56*b* within which brushes 28*a*, 28*b* are disposed. Manifold 50 may be secured within valley by an adhesive, such as contact cement or the like.

Figure 4:
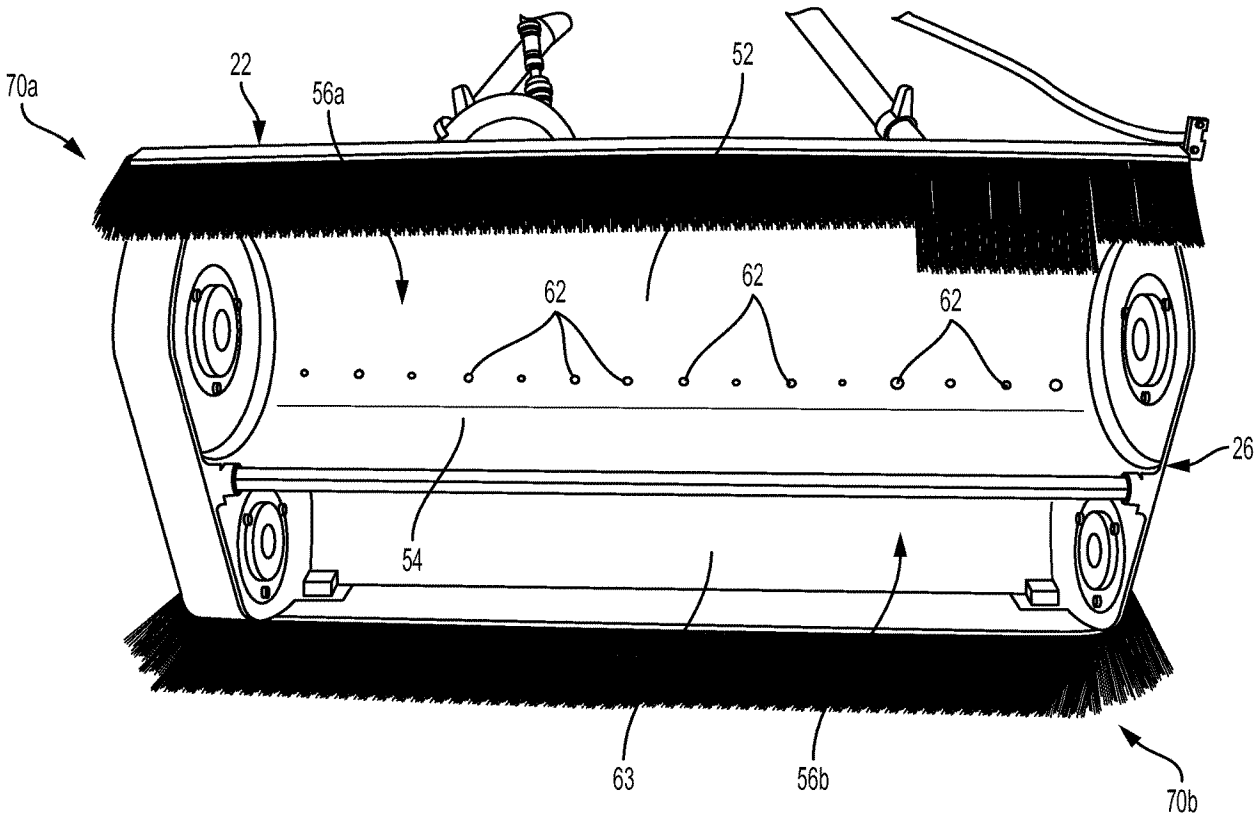
FIG. 4 is a bottom view of the floor cleaner device of FIG. 2 showing the brushes removed and disclosing foam discharge apertures formed in a cover plate.

Cleaning device 22 further includes an electric motor 58 and associated power trains or gearing systems for rotating cylindrical brushes 28*a*, 28*b* about their elongate axes, as well as a cover member 60 encapsulating base 26, with tube 50 passing through cover member 60. In operation brushes 28*a*, 28*b* are configured to counter rotate relative to each other, and in particular in the illustrated embodiment are configured to rotate whereby the bristles of brushes 28*a*, 28*b* spin upwardly toward valley 54. As understood from FIG. 4, multiple foam discharge apertures 62 are formed in cover plate 52 adjacent valley 54, with apertures 62 extending into manifold 50. In the illustrated embodiment, apertures 62 are formed on either side of valley 54 and are of varying diameter relative to the location at which hose 48 connects with manifold 50, with the larger diameter apertures being further from the connection to promote an even volume of foam to be discharged through apertures 62.

Discharge apertures 62 are thus located generally centrally within base 26, and in particular adjacent brushes 28*a*, 28*b* via the location of manifold 50, with apertures 62 being located above the rotational axes of brushes 28*a*, 28*b* on either side of valley 54 whereby foam is discharged at or on both brushes 28*a*, 28*b*. It should thus be appreciated that the foam cleaning solution is discharged within an area or enclosure or internal cavity 63 of base 26, where cavity 63 is defined in part by cover plate 52 which defines an upper wall of cavity 63, with foam being discharged in particular within or at the channels 56*a*, 56*b* of brushes 28*a*, 28*b* to promote the delivery of the foam cleaning solution to the brushes 28*a*, 28*b* and thereby the cleaning of carpeted floor 30.

Figure 6:
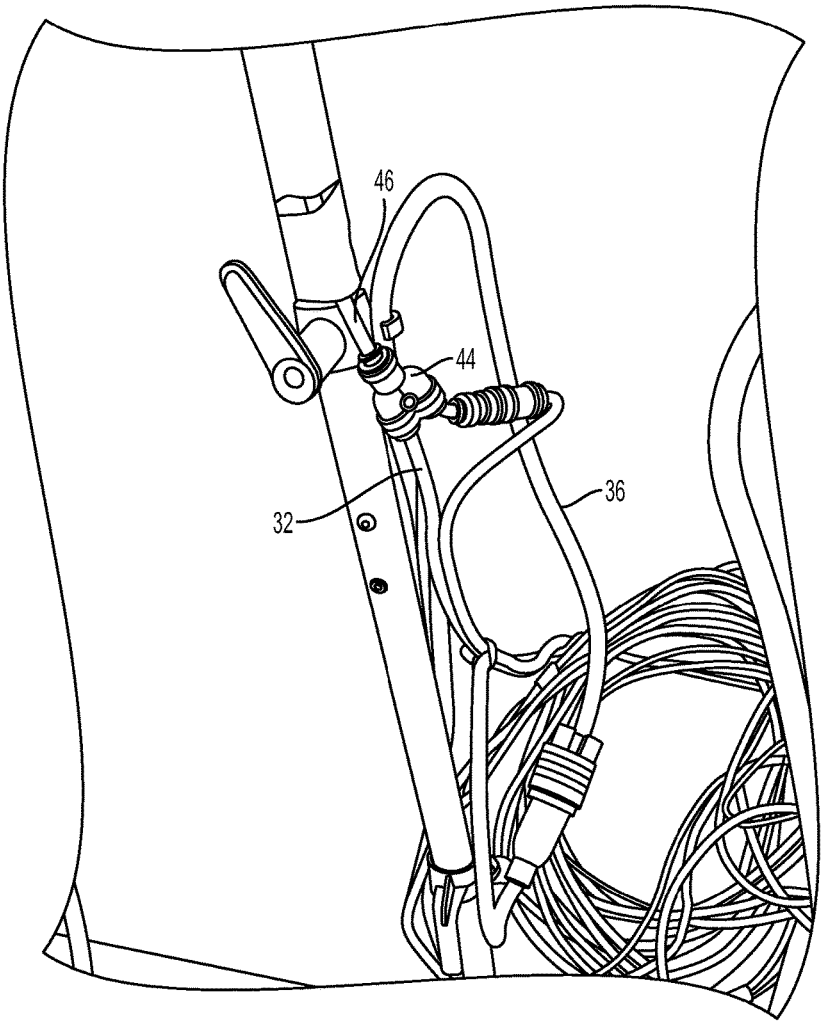
FIG. 6 is a partial close-up view of the floor cleaner device showing the connection of lines from the tank apparatus.
Figure 7:
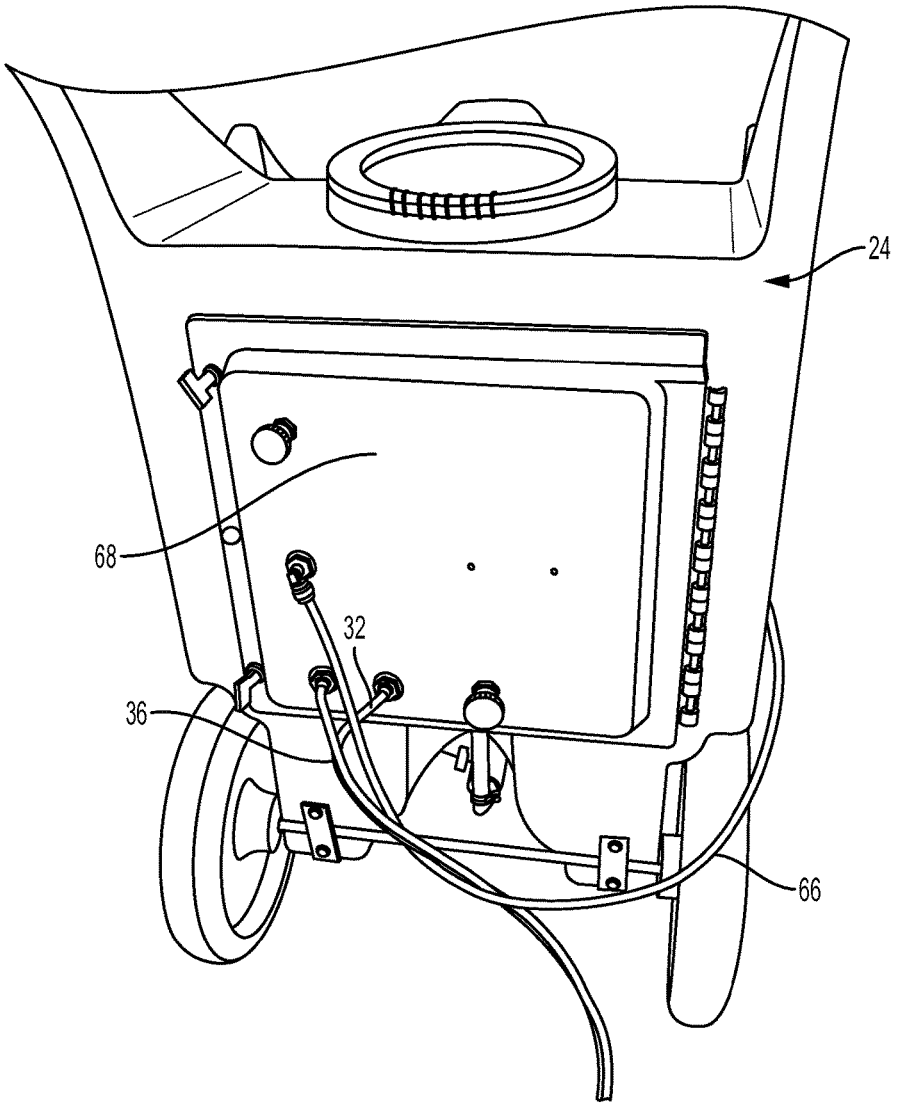
FIG. 7 discloses a rear portion of the tank apparatus of FIG. 1.

Tank apparatus 24, which comprises a foam generating apparatus, will now be discussed in further detail with reference to FIGS. 1, 6 and 7. Apparatus 24 includes an internal volume or reservoir 64 within which a liquid cleaning solution is contained. Air compressor 34 supplies compressed air via hose 66 to a control panel 68 of apparatus 24. An internal pump of apparatus 24 is then used to deliver the cleaning solution to cleaning device 22 via hose 32, with hose 36 delivering compressed air from control panel 68 to cleaning device 22. The cleaning solution and compressed air then interact to generate the foam, which is then delivered through hose 48 to base 26 as discussed above. In particular, the liquid cleaning solution delivered via hose 32 and compressed air delivered via hose 36 initially combine and interact at connector 44, with the foam thereby being created and propagating through hose 46 disposed about handle 42, and further through connector 49 and hose 48, which then delivers the foam to manifold 50 for discharge out of apertures 62. Electrical power is supplied to both cleaning device 22 and apparatus 24 via conventional power cords.

Tank 24 may be selectively moved and positioned within a room for readily aiding in the delivery of liquid cleaning solution and compressed air to cleaning device 22 whereby an operator is able to readily clean a flooring surface 30 with a foam cleaning solution.

Figure 8:
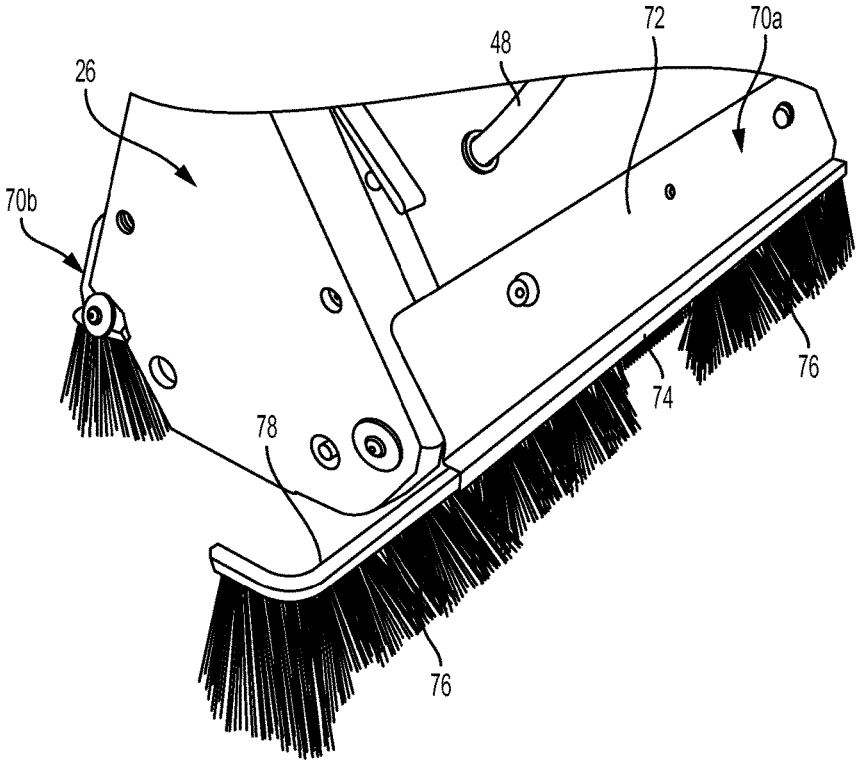
FIG. 8 is a partial perspective view of the lower portion of the floor cleaner apparatus disclosing a brush partially installed thereon.
Figure 9:
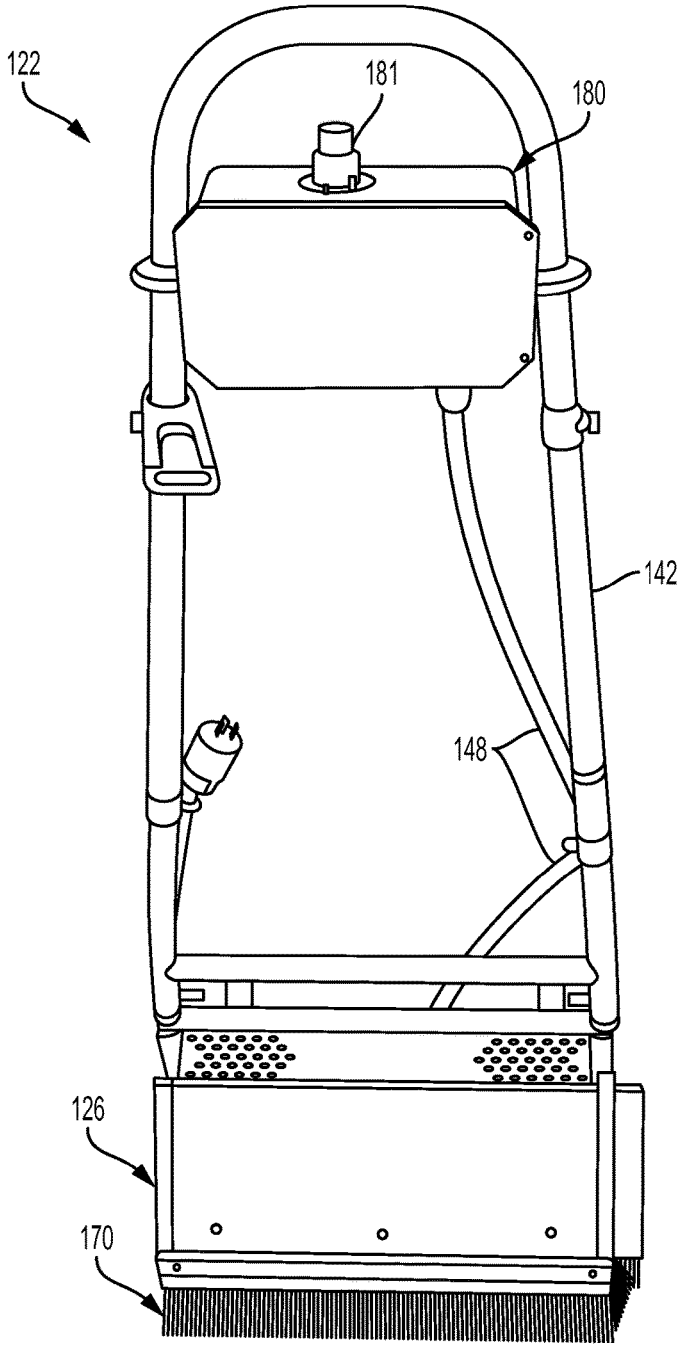
FIG. 9 is a perspective view of an alternative floor cleaner device in accordance with the present invention.

Referring now to FIG. 8, base 26 is shown to further include a pair of brush assemblies 70*a*, 70*b* located on both of the respective elongate sides of base 26, where the brush assemblies 70*a*, 70*b* aid in retention of foam within the internal cavity 63 of base 26. Each of the brush assemblies 70*a*, 70*b* includes a plate 72 having a track 74, with the plates 72 being secured to cover member 60. A pair of brushes 76 are mounted within each track 74, where the brushes include a support bar 76 that slides within tracks 74. Each brush 76 includes an angled outer end that curves around to the shorter sides of cleaning device 22 to further promote retention of foam within cavity 63.

In the illustrated embodiment, tank apparatus 24 comprises a foam generating device supplied by Innovative Cleaning Equipment, Inc., of Grand Rapids, Mich. Still further, in the illustrated embodiment, cleaning device 22 comprises a modified conventional counter rotating brush floor cleaning machine, such as may be provided by XL North of Fall River, Mass. under the brand name XLerator. Although the disclosed cleaning device 22 includes a pair of cylindrical, counter rotating brushes it should be appreciated that a cleaning device in accordance with the present invention may be provided with an alternative number of brushes.

Referring now to FIGS. 9-12A, an alternative cleaning device 122 is disclosed that is of substantially similar construction to cleaning device 22, with like disclosed features being identified with similar reference numbers, but with 100 added to the features of cleansing device 122. Not all of the features of cleaning device 122 are discussed herein due to the similarities with cleaning device 22.

Cleaning device 122 includes a base or lower portion 126 within which a pair of cylindrical brushes are mounted for driven rotation, such as brushes 28*a*, 28*b* discussed above. Cleaning device 122 further includes a handle 142 by which an operator is able to move cleaning device 122 over a flooring surface, such as a carpeted surface, for cleaning. Front and back brush assemblies 170 (front only shown in FIG. 9) are also provided.

Cleaning device further includes a control box or control unit 180 mounted to handle 142, with a control knob 181 operatively connected with control unit 180. In the illustrated embodiment handle 142 is U-shaped, with control unit 180 being mounted between the downward extending legs or portions of handle 142. Control unit 180 receives a liquid cleaning solution, which comprises a mixture with water, and receives compressed air via hoses (not shown), such as hoses 32 and 36, respectively, discussed above. Foam is then created, generated and/or propagated in control unit 180 and delivered through control unit 180 to base portion 126 via hose 148.

Figure 10:
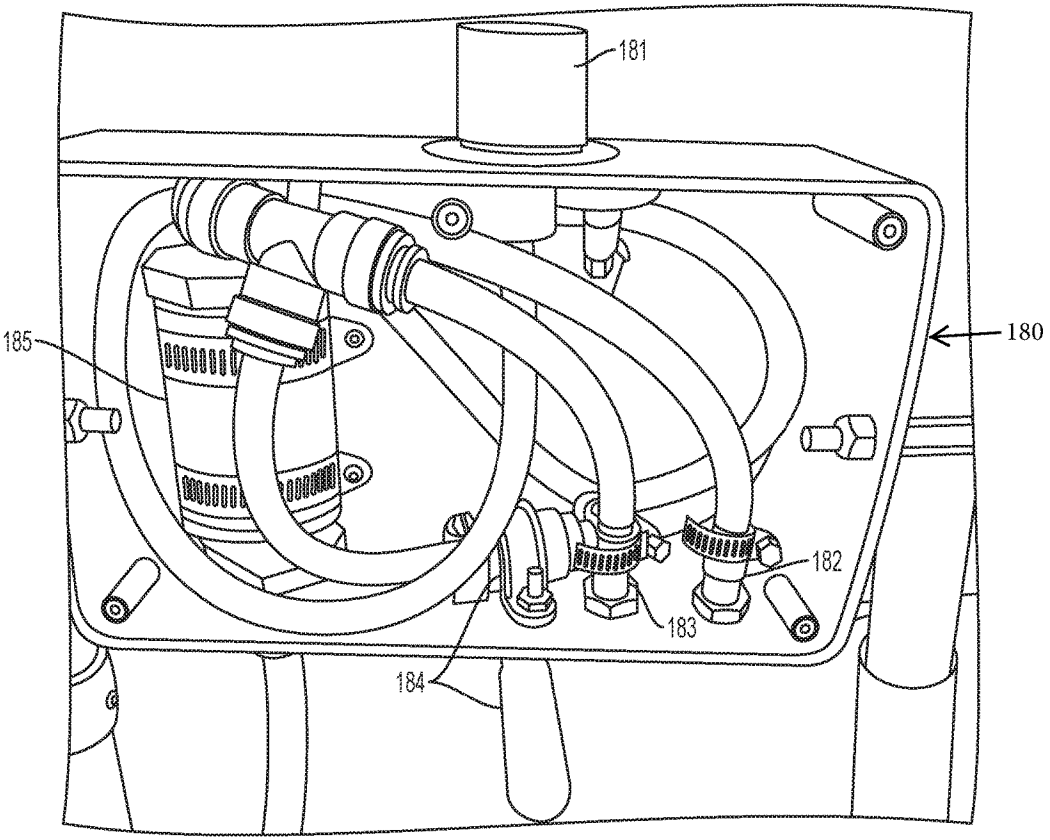
FIG. 10 is a perspective interior view of a control unit portion of the floor cleaner device of FIG. 9.

With reference to FIG. 10, control unit 180 is shown to include a pair of inlets 182, 183, which are disclosed as fittings, for receiving liquid cleaning solution and compressed air. Inlet 182 receives the liquid cleaning solution and water mixture via a hose, such as in the manner of hose 32 discussed above. Inlet 183 receives compressed air via a separate hose, such as in the manner of hose 36 discussed above.

Control unit 180 further includes a valve 184 for selectively turning on or off the delivery of both the compressed air and liquid cleaning solution and water mixture to control unit 180. Control unit additionally includes a canister 185 for generating and/or propagating the creation of foam for delivery to base portion 126 via hose 148, as discussed in more detail below. Various hoses are provided within control unit 180 for delivery of liquid cleaning solution and compressed air to canister 185, as well as to valve 184 and control knob 181, where control knob 181 includes a valve for controlling the flow of compressed air delivery for mixing with the liquid cleaning solution and water.

Figure 11:
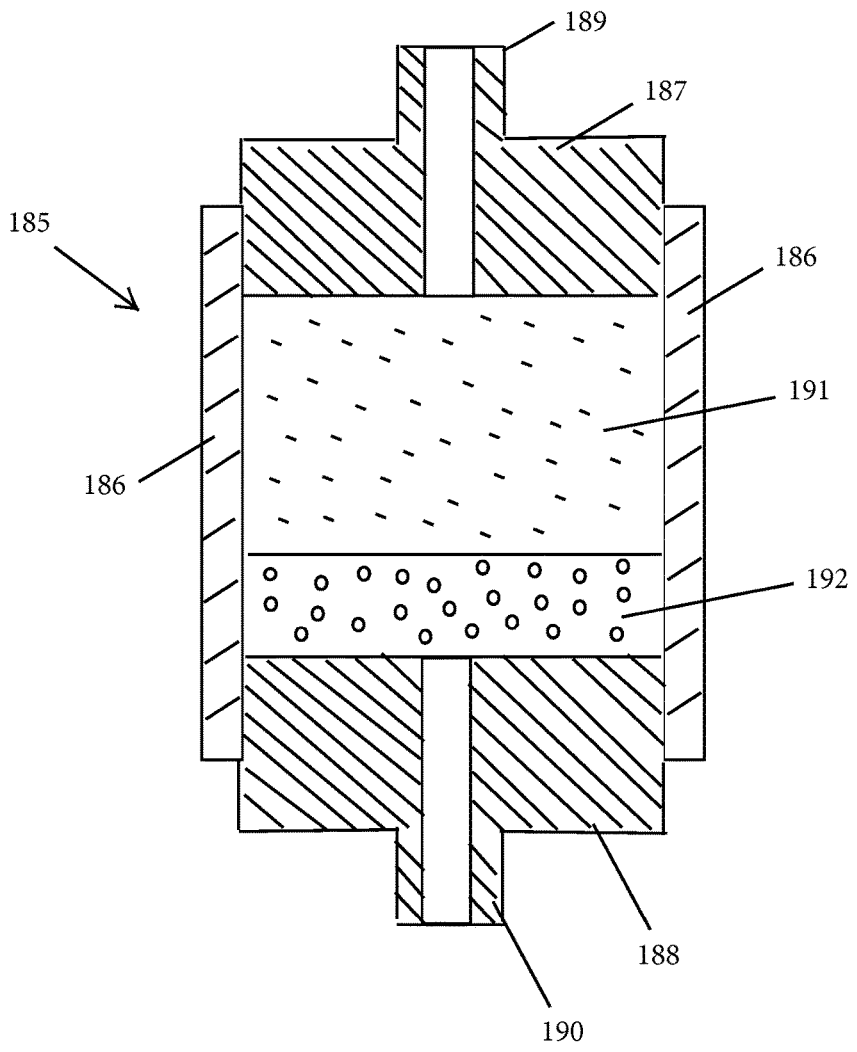
FIG. 11 is a side elevation cutaway view of a canister for promoting generation of foam removed from the control box of FIG. 10.

With particular reference to FIG. 11, canister 185 includes an outer wall 186 defining a housing to which an upper cap 187 and a lower cap 188 are connected, with caps 187, 188 being engaged with wall 186 via a threaded connection. Upper cap 187 includes an upper fitting 189 to which is connected a hose or hoses for delivery of liquid cleaning solution and compressed air that is driven through canister 185 toward lower cap 188. Lower cap 188 in turn includes a lower fitting 190 to which is connected hose 148 for delivery of foam to base portion 126. Porous material is positioned between upper cap 188 and lower cap 188, which in the illustrated embodiment comprises a first or upper porous material 191 and a second or lower porous material 192. Upper porous material 191, in the illustrated embodiment, is constructed to have a tighter weave than lower porous material 192, such that lower porous material 192 is more porous than upper porous material 191, but with lower porous material 192 also being more rigid than upper porous material 191. Lower porous material 192 may be constructed of material from, for example, a 3M "Hi Pro" stripping pad and upper porous material 191 may be constructed of, for example, a 3M "Surface Preparation Pad" ("SPP"). Lower porous material 192 thus provides a rigid and porous material for support of upper porous material 191, while allowing foam to exit canister 185.

Figure 12:
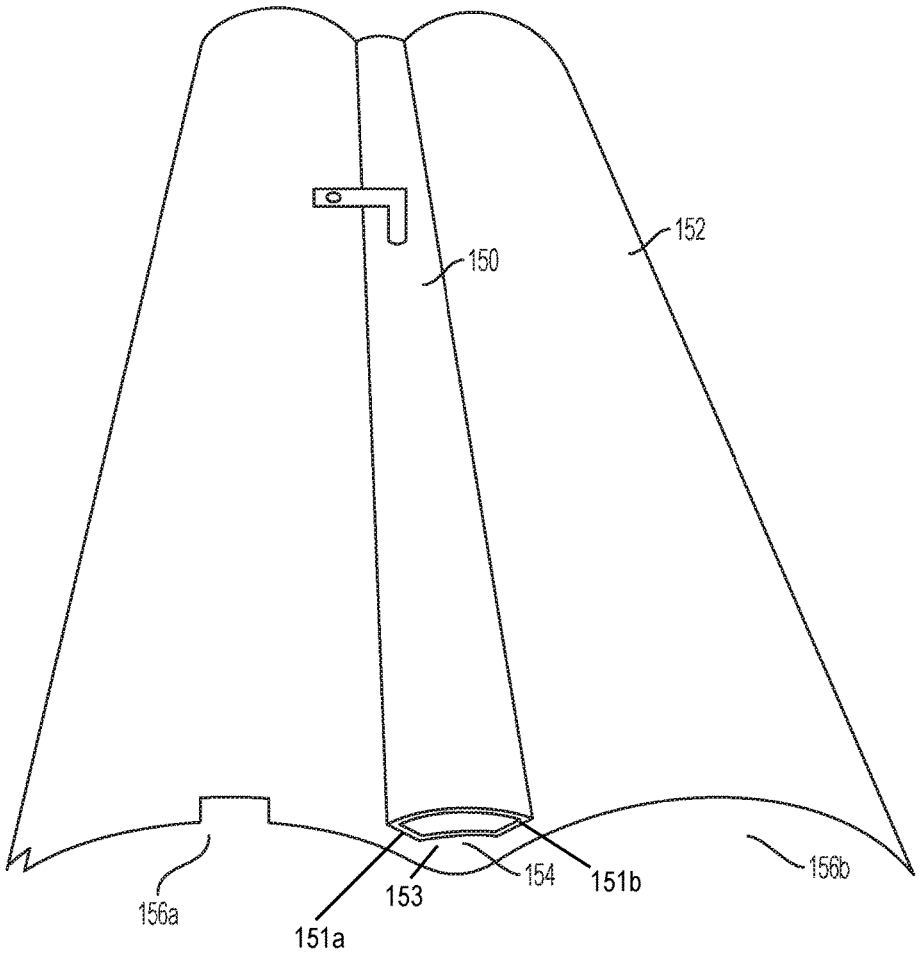
FIG. 12 is an inside top perspective view of the brush cover plate of the floor cleaner device of FIG. 9 removed from the floor cleaner device and showing the manifold mounted thereto.

FIG. 12 discloses brush cover plate 152 removed from cleaning device 122, where cover plate 152 is identical to cover plate 52. Internal manifold or tube 150 is secured to cover plate 152 at valley 154 of cover plate 152, where valley 154 separates channels 156*a*, 156*b* within which brushes are disposed for rotation. Manifold 150 in turn is connected to hose 148 for delivery of foam to manifold 150. Although not shown, a T-connector may be affixed to the end of hose 148 for supplying foam to manifold 150 at more than one entry point. In the illustrated embodiment manifold 150 has a crescent shaped profile with generally flat sides 151*a*, 151*b* affixed to the interior surface of cover plate 152. A gap 153 is provided between manifold 150 and valley 154 whereby a motor support rod can be disposed.

Figure 12A:
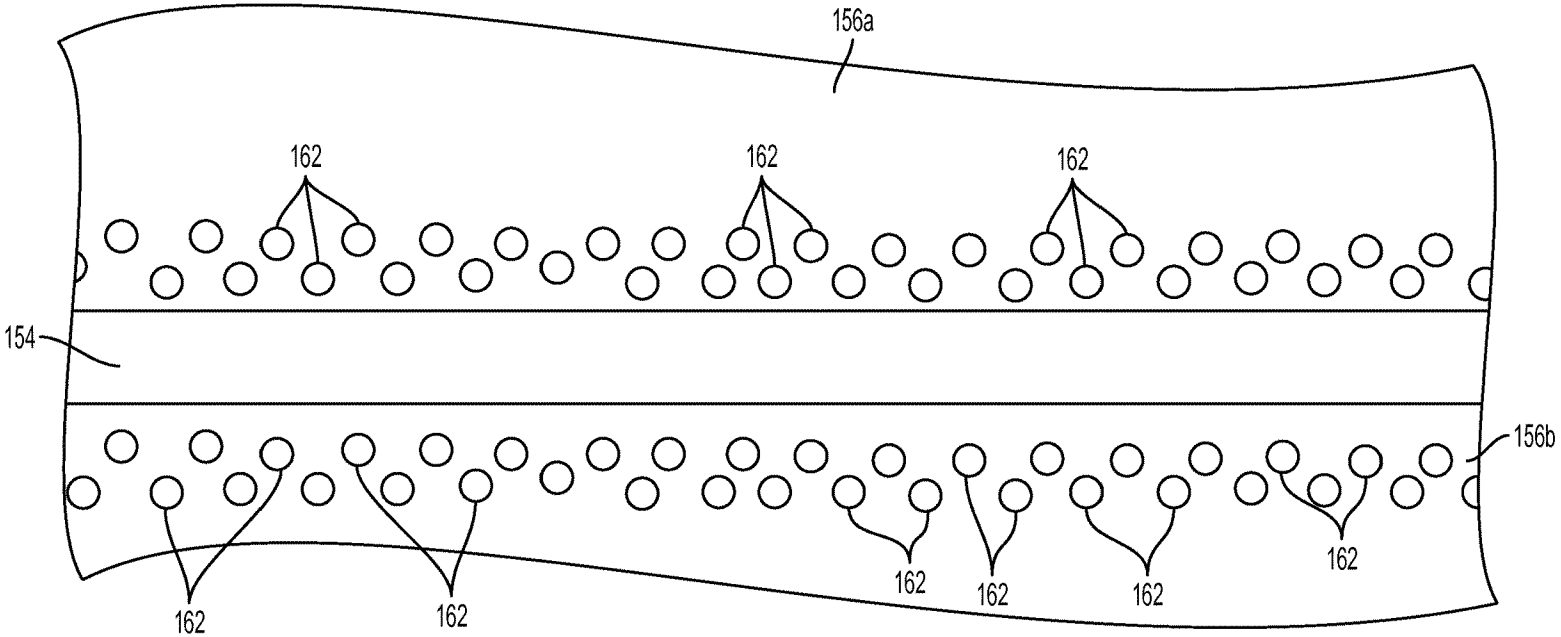
FIG. 12A is a partial view of the brush cover plate of FIG. 12 from the opposite side of FIG. 12 showing the apertures extending into the manifold.
Figure 13:
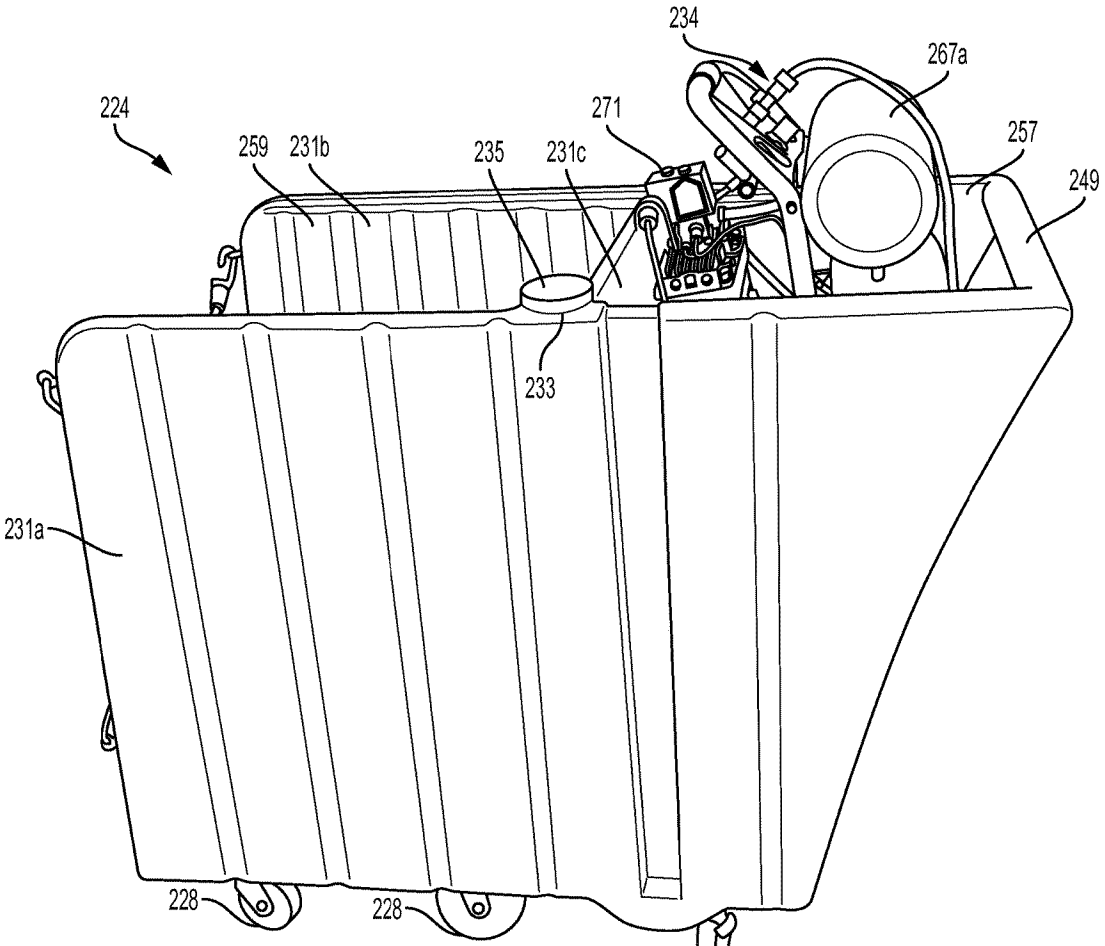
FIG. 13 is a side perspective view of an alternative cart apparatus in accordance with the present invention.
Figure 14:
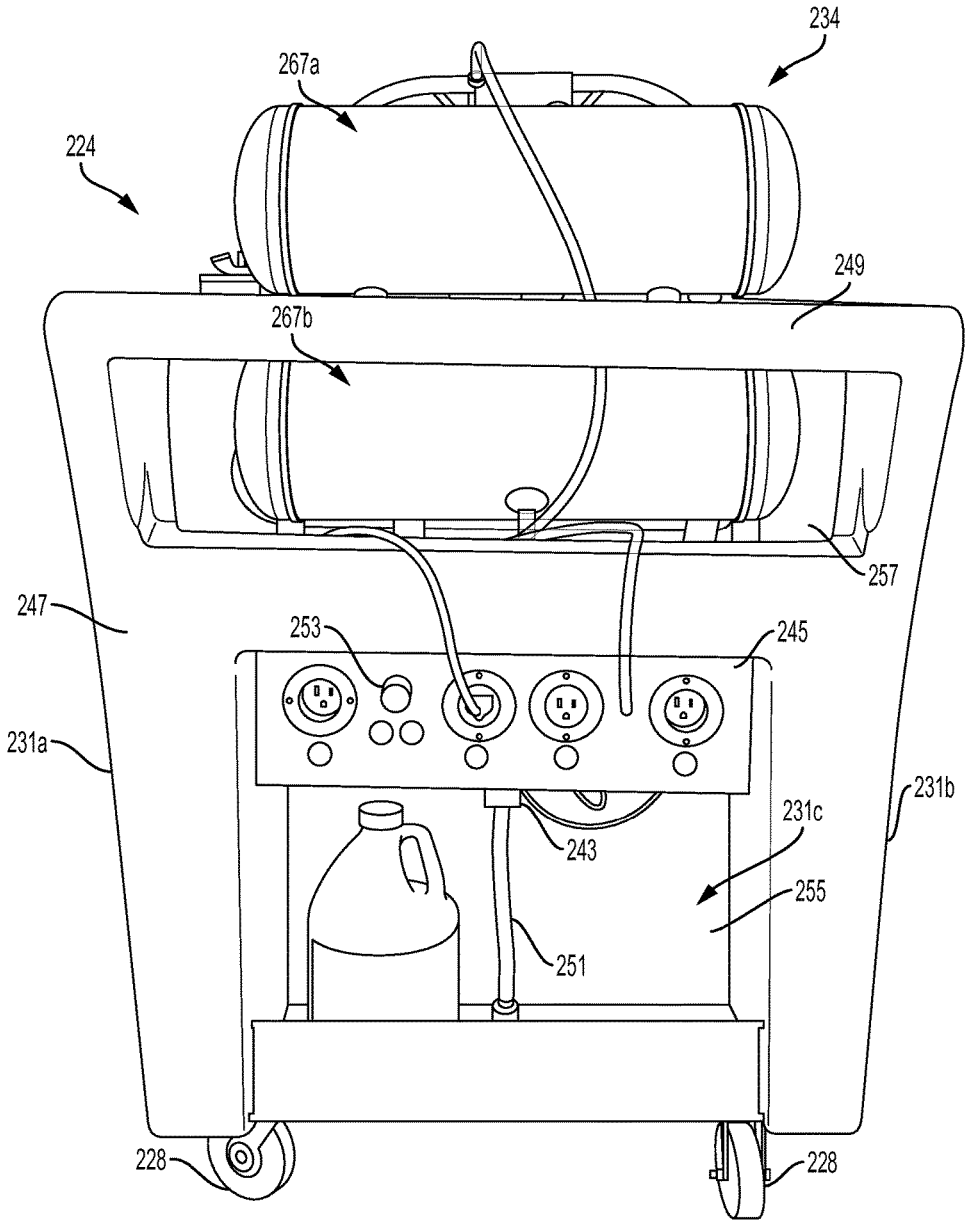
FIG. 14 is a rear end perspective view of the cart apparatus of FIG. 13.
Figure 15:
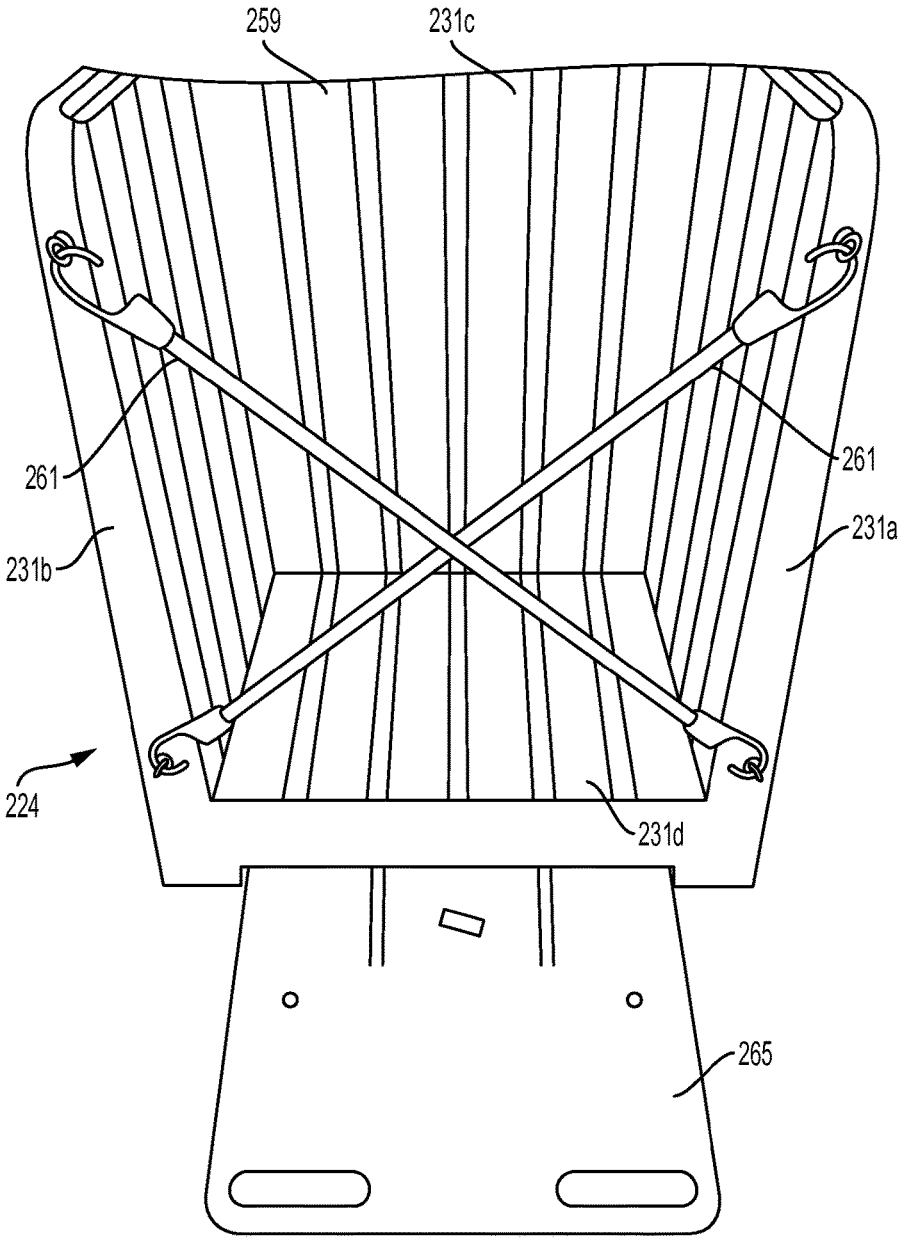
FIG. 15 is a front end perspective view of the cart apparatus of FIG. 13.
Figure 16:
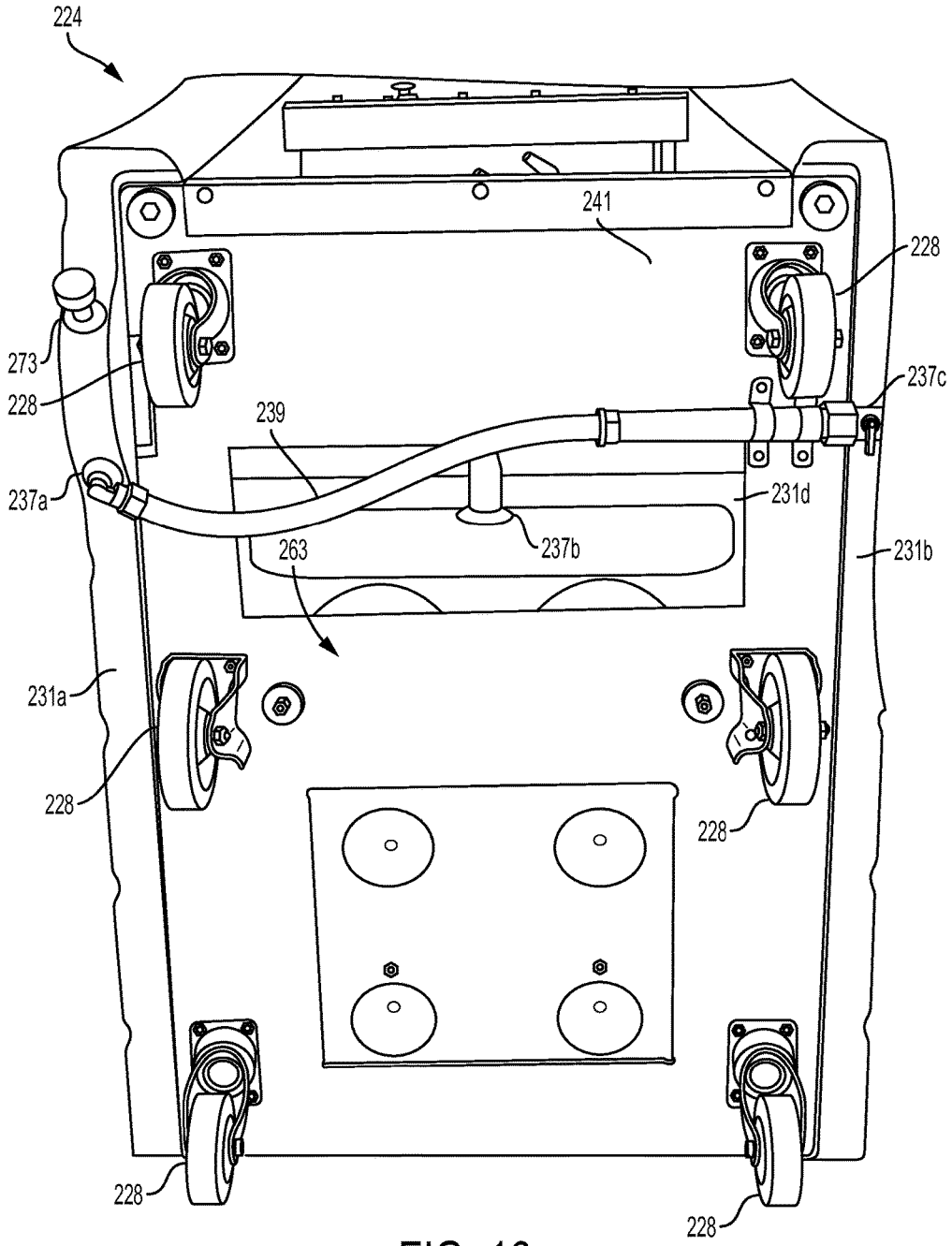
FIG. 16 is a bottom perspective view of the cart apparatus of FIG. 13.

A portion of the opposite side of cover plate 152 is disclosed in FIG. 12A from that shown in FIG. 12, with FIG. 12A disclosing foam discharge apertures 162 located on either side of valley 154. Apertures 162 extend through cover plate 152 into manifold 150 whereby foam is discharged from manifold 150 onto the two spinning brushes, such as brushes 28*a*, 28*b*, located within channels 156*a*, 156*b*.

Referring now to FIGS. 13-17, an alternative cart apparatus or tank apparatus 224 is disclosed. Apparatus 224 is configured for operation with a floor cleaning device, such as device 22 or 122, to provide a liquid cleaning solution and water mixture, as well as compressed air to the device. Apparatus 224 includes a plurality of wheels 228 to enable movement of the apparatus 224 to a desired location, with hoses then connected between apparatus 224 and device 22, 122 for delivering the water/liquid cleaning solution mixture and compressed air to device 22, 122. Apparatus 224 and device 22, 122 thus provide an effective system for foam cleaning of a flooring surface, such as a carpeted surface.

Apparatus 224 includes multiple hollow walls within which the liquid cleaning solution may be retained for delivery to cleaning device 22, 122, and includes multiple cavities within which various components may be retained. Regarding the hollow walls, apparatus 224 includes hollow side walls 231*a*, 231*b*, and includes a hollow center wall 231*c* extending between side walls 231*a*, 231*b*, and further includes a hollow bottom wall 231*d*. A fill hole 233 is provided on side wall 231*a* with a removable cap 235 disposed there over for selective filling of apparatus 224. The various hollow walls are formed by spaced wall portions, such as inner and outer wall portions, and thus define a reservoir that may be internally fluidly interconnected, and in the illustrated embodiment retains approximately 30 to 40 gallons. Still further, ports 237*a*, 237*b*, 237*c* are provided on a bottom side 239 (FIG. 16) of apparatus 224 that are connected via a hose 214. The liquid cleaning solution may then be delivered via a pump 243 disposed adjacent control panel 245 at a rear end 247 of apparatus 224 adjacent handle 249, where pump 243 is in fluid communication with the liquid cleaning solution contained within apparatus 224 via hose 251, where a hose line, such as line 32, for delivering fluid to cleaning device 22, 122 may be connected to control panel 245, such as to a fitting 253. A filter may also be provided to remove sediment from the tank, such as prior to pumping. A drain 273 (FIG. 16) is further provided on bottom side 239 to remove liquid from the reservoir.

As noted, apparatus 224 includes various cavities formed by hollow walls, including lower rear cavity 255 within which control panel 245 is disposed and which forms a shelf for retention of cleaning materials, such as bottled solutions and the like. Apparatus 224 further includes an upper rear cavity 255 within which an air compressor 234 may be located, with air compressor 234 being connectable to control panel 245 to receive power, such as via a power outlet. Still further, a front cavity 259 is provided that may be used to store floor cleaning device 22, 122 for transporting to a job site, as well as may be used for transporting other equipment and/or materials. In the illustrated embodiment front cavity 259 defines an open cavity with a pair of retention members 261 being provided to aid in holding equipment therein. In the illustrated embodiment retention members are removable elastic bungee cords, but could alternatively be constructed as one or more rigid members. Apparatus further includes a rigid bottom panel 263 (FIG. 16) to which wheels 228 are mounted. Panel 263 further forms a pocket for receiving a slide out shelf 265 (FIG. 15) that may be used to support and/or transport additional equipment and/or cleaning supplies.

Figure 17:
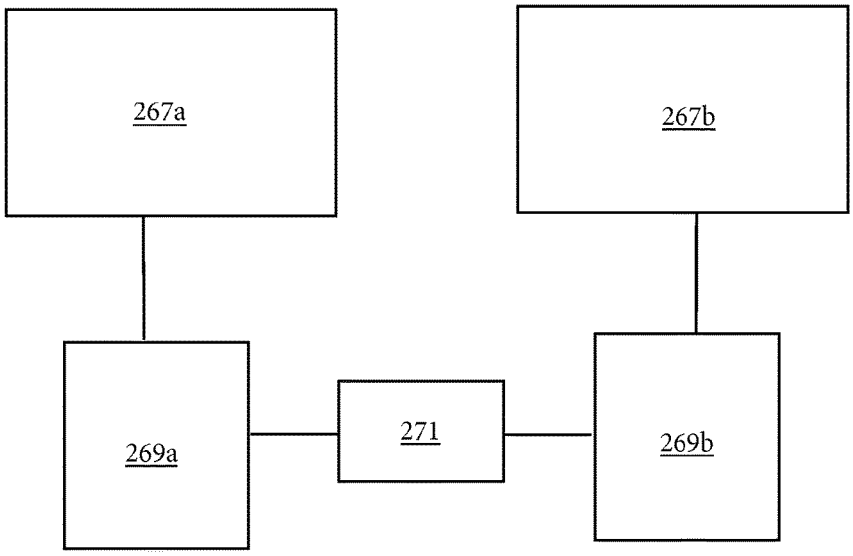
FIG. 17 is a schematic depiction of a compressor control system used with the cart apparatus of FIG. 13.

In the illustrated embodiment, air compressor 234 includes a pair of tanks 267*a*, 267*b* with a pair of motors 269*a*, 269*b* for compressing air into the tanks 267*a*, 267*b*. With reference to FIG. 17, a relay switch 271 with an integrated timer is disposed between motors 269*a*, 269*b*. Motors 269*a*, 269*b* are connected with relay switch to receive power and for selectively actuating one or the other of motors 269*a*, 269*b*. In a particular embodiment, relay switch 271 is configured to switch operation between motors 269*a*, 269*b* every approximately 20 minutes. By operation in this manner adequate compressed air may be generated without continuous operation of one motor, which could result in damage to a single compressor. In a particular embodiment, air compressor 234 may be constructed from a pair of California Air Tools ("CAT") Model 160A air compressors operatively connected together. It should be appreciated, however, that alternative constructions for air compressor 234 may be employed.

In operation, a user is able to readily transport cleaning equipment via cart/tank apparatus 224, including a floor cleaning device 22 or 122 and a liquid cleaning solution, such as one that includes a water and cleaner mixture. Apparatus 224 enables an adequate supply of liquid cleaning solution to be transported and used at the job site, without the necessity of the cleaning solution being retained on the cleaning device 22, 122 itself. Due to the weight of water, only a limited supply would otherwise be able to be retained on the handheld, non-wheeled cleaning device 22, 122 due to the inability of an operator to support such weight and volume of cleaning solution. As a flooring surface is cleaned, the tank/cart apparatus 224 may be moved to alternative locations while being in fluid communication with the cleaning device 22, 122. Moreover, the ability to supply both liquid cleaning solution and compressed air enables the generation of foam to provide superior cleaning than without foam.

Changes and modifications in the specifically described embodiments can be carried out without departing from the principles of the present invention which is intended to be limited only by the scope of the appended claims, as interpreted according to the principles of patent law including the doctrine of equivalents. For example, different hollow wall configurations may be provided, such as may create different cavity configurations, including the ability to locate various components, such as the air compressor, in alternative locations.

The embodiments of the invention in which an exclusive property or privilege is claimed are defined as follows:

1. A floor cleaning system, said floor cleaning system comprising:

a floor cleaning device, said floor cleaning device comprising a base portion and a handle operatively connected with said base portion and configured to enable an operator to manipulate said base portion over a floor surface, said base portion defining an internal cavity and including a cover plate, said cover plate including a pair of channels with a downwardly projecting valley disposed between said channels, said floor cleaning device further comprising a pair of cylindrical brushes disposed for rotation within said internal cavity, said brushes rotating along horizontally oriented axes with each said brush disposed for rotation at least partially within a respective one of said channels, said floor cleaning device further comprising a manifold disposed at said valley and a supply line configured to deliver foam to said manifold, and wherein a plurality of apertures are disposed within said internal cavity with said apertures operatively connected with said manifold whereby foam delivered through said supply line to said manifold is discharged out of said apertures in said internal cavity, and wherein said apertures are disposed vertically above at least a portion of said brushes so as to discharge foam at said brushes.

2. The floor cleaning system of claim 1, wherein said brushes comprise counter rotating brushes and wherein said apertures are disposed laterally between the axes of said brushes so as to discharge foam downwardly at said brushes.

3. The floor cleaning system of claim 1, wherein said cover plate comprises an upper wall defining a portion of said internal cavity, and wherein said apertures are disposed in both said channels of said cover plate along an axial length of said channels, and wherein said apertures extend through said cover plate and into said manifold.

4. The floor cleaning system of claim 1, wherein said manifold is disposed vertically above said cover plate relative to said brushes and in said valley of said cover plate, and wherein said manifold has a pair of elongate sides with said sides of said manifold affixed to respective ones of said channels of said cover plate, and wherein said apertures are disposed in both said channels and extend through said cover plate and into said manifold through said sides of said manifold whereby foam is discharged through said apertures downwardly at said brushes, and wherein a gap is formed between said cover plate and said manifold at said valley.

5. The floor cleaning system of claim 1, further including a tank apparatus, said tank apparatus including wheels and configured to being moved by an operator within an interior space having a floor surface that is to be cleaned, said tank apparatus including a reservoir for retaining a liquid cleaning solution and an air compressor;

wherein an airline extends from said air compressor to said floor cleaning device for delivering compressed air generated by said air compressor from said tank apparatus to said floor cleaning device, and wherein a solution line extends from said tank apparatus to said floor cleaning device for delivering liquid cleaning solution from said reservoir of said tank apparatus to said floor cleaning device, and wherein said floor cleaning device is configured to receive compressed air and liquid cleaning solution with the compressed air and liquid cleaning solution being mixed together to produce foam at said floor cleaning device.

6. The floor cleaning system of claim 5, further including a fitting configured to receive said airline with said airline comprising a compressed air hose and including a fitting configured to receive said solution line with said solution line comprising a hose supplying liquid cleaning solution.

7. The floor cleaning system of claim 5, wherein said floor cleaning device further includes a control valve to adjust the supply of compressed air.

8. The floor cleaning system of claim 5, further including a porous material contained within a housing, said housing being in fluid communication with said supply line, said housing configured to receive compressed air from said airline and liquid cleaning solution from said solution line and to enable compressed air and liquid cleaning solution to pass through said housing to generate foam, and wherein said supply line extends from said housing to said manifold.

9. The floor cleaning system of claim 1, wherein said brushes comprise counter rotating brushes and wherein said cover plate comprises an upper wall defining a portion of said internal cavity and said apertures are disposed in both said channels of said cover plate along an axial length of said channels, and wherein said apertures extend through said cover plate and into said manifold and said manifold is disposed vertically above said cover plate relative to said brushes and in said valley of said cover plate, and wherein said manifold has a pair of elongate sides with said sides of said manifold affixed to respective ones of said channels of said cover plate, and wherein said apertures extend through said cover plate and into said manifold through said sides of said manifold whereby foam is discharged through said apertures downwardly at said brushes.

10. The floor cleaning system of claim 1, further including a non-rotating brush mounted to said base portion, said non-rotating brush configured to substantially enclose said brush within said internal cavity.

11. A floor cleaner system, said floor cleaner system comprising:

a floor cleaning device comprising a base portion, said base portion defining an internal cavity, a handle operatively connected with said base portion and configured to enable an operator to manipulate said base portion over a floor surface to be cleaned, a pair of counter rotating cylindrical brushes disposed for rotation within said internal cavity, said brushes rotating along horizontally oriented parallel axes, a housing mounted to said floor cleaning device, and a supply line configured as an elongate tube to deliver foam from said housing to said base portion, wherein a manifold is disposed in said base portion, said manifold being operatively connected with said supply line and including a plurality of apertures whereby foam delivered through said supply line is supplied into said manifold and discharged out of said apertures in said internal cavity, wherein said manifold is disposed vertically above at least a portion of said brushes and extends longitudinally between the axes of said brushes whereby said apertures discharge foam downwardly toward said brushes;

a tank apparatus, said tank apparatus including wheels and configured to being moved by an operator within an interior space having the floor surface that is to be cleaned, said tank apparatus being separately and independently moveable over the floor surface relative to said floor cleaning device and said tank apparatus including a reservoir for retaining a liquid cleaning solution;

an air compressor mounted to said tank apparatus;

an airline extending from said air compressor to said floor cleaning device for delivering compressed air generated by said air compressor from said tank apparatus to said housing of said floor cleaning device; and a solution line extending from said tank apparatus to said floor cleaning device for delivering liquid cleaning solution from said reservoir of said tank apparatus to said housing of said floor cleaning device;

wherein said housing is separated from said manifold by said supply line and wherein said housing of said floor cleaning device is configured to receive compressed air from said airline and liquid cleaning solution from said solution line with the compressed air and liquid cleaning solution being mixed together in said housing at said floor cleaning device to produce foam, and with foam produced in said housing being delivered through said supply line to said manifold at said base portion.

12. The floor cleaner system of claim 11, wherein said housing contains a porous material to produce foam for delivery through said supply line to said manifold.

13. The floor cleaning device of claim 12, further including a control valve at said floor cleaning device to adjust the supply of compressed air supplied to said housing.

14. The floor cleaner system of claim 11, said base portion including a cover plate at said internal cavity, said cover plate including a pair of channels with a downwardly projecting valley disposed between said channels, and wherein each said brush is disposed for rotation at least partially within a respective one of said channels, and wherein said manifold is disposed at said valley and wherein said cover plate includes a plurality of apertures whereby foam delivered through said supply line to said manifold is discharged out of said manifold and through said apertures in said cover plate, and wherein said apertures in said cover plate are disposed vertically above at least a portion of said brushes so as to discharge foam at said brushes.

15. A floor cleaner system, said floor cleaner system comprising:

a floor cleaning device comprising a base portion, said base portion defining an internal cavity, a brush disposed for rotation within said internal cavity, a manifold disposed vertically above at least a portion of said brush, a supply line configured as an elongate tube to deliver foam to said manifold, and a plurality of apertures disposed in said manifold whereby foam delivered through said supply line is discharged out of said apertures in said internal cavity, said floor cleaning device further including a handle operatively connected with said base portion and configured to enable an operator to manipulate said base portion over a floor surface to be cleaned, and wherein a housing is mounted to said floor cleaning device;

a tank apparatus, said tank apparatus configured to being moved by an operator within an interior space having the floor surface that is to be cleaned, said tank apparatus being separately and independently moveable over the floor surface relative to said floor cleaning device and said tank apparatus including a reservoir for retaining a liquid cleaning solution;

an air compressor mounted to said tank apparatus;

an airline extending from said air compressor to said floor cleaning device for delivering compressed air generated by said air compressor from said tank apparatus to said housing of said floor cleaning device; and a solution line extending from said tank apparatus to said floor cleaning device for delivering liquid cleaning solution from said reservoir of said tank apparatus to said housing of said floor cleaning device;

wherein said housing is separated from said manifold by said supply line and wherein said housing of said floor cleaning device is configured to receive compressed air from said airline and liquid cleaning solution from said solution line with the compressed air and liquid cleaning solution being mixed together in said housing at said floor cleaning device to produce foam, and with foam produced in said housing being delivered through said supply line and to said manifold at said base portion.

16. The floor cleaner system of claim 15, wherein said brush comprises a pair of counter rotating cylindrical brushes disposed for rotation within said internal cavity with said brushes rotating along horizontally oriented parallel axes, and wherein said manifold is disposed vertically above at least a portion of said brushes and extends longitudinally between the axes of said brushes whereby said apertures discharge foam downwardly toward said brushes.

17. The floor cleaner system of claim 15, wherein said tank apparatus includes wheels.

18. The floor cleaner system of claim 15, wherein said tank apparatus includes hollow walls with said hollow walls defining a reservoir configured to contain the liquid cleaning solution.

19. The floor cleaner system of claim 18, wherein said hollow walls comprise a pair of vertically upright and spaced apart side walls and a lower base wall, and wherein said upright side walls and said lower base wall are in fluid communication, and wherein said lower base wall and said upright side walls define a cavity of said tank apparatus between said upright side walls, with said cavity configured for receiving items for transport by said tank apparatus.

20. The floor cleaner system of claim 15, wherein said tank apparatus, includes at least one electrical power outlet for providing electrical power from said tank apparatus.

21. The floor cleaner system of claim 15, said base portion including a cover plate at said internal cavity, said cover plate including a pair of channels with a downwardly projecting valley disposed between said channels, and wherein said brush comprises a pair of cylindrical brushes disposed for rotation within said internal cavity, said brushes rotating along horizontally oriented axes with each said brush disposed for rotation at least partially within a respective one of said channels, and wherein said manifold is disposed at said valley and wherein said cover plate includes a plurality of apertures whereby foam delivered through said supply line to said manifold is discharged out of said manifold and through said apertures in said cover plate, and wherein said apertures in said cover plate are disposed vertically above at least a portion of said brushes so as to discharge foam at said brushes.

* * * * *